US008368728B2

(12) United States Patent
Chen et al.

(10) Patent No.: US 8,368,728 B2
(45) Date of Patent: Feb. 5, 2013

(54) ADAPTIVE FEEDBACK CONTROL METHOD OF FSC DISPLAY

(75) Inventors: Chun-Ho Chen, Changhua County (TW); Shih-Hsun Chien, Changhua County (TW); Fang-Cheng Lin, Taichung County (TW); Yi-Pai Huang, Chiayi (TW); Han-Ping Shieh, Hsinchu (TW); Wen-Chih Tai, Hsinchu County (TW); Shian-Jun Chiou, Taipei (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 552 days.

(21) Appl. No.: 12/698,579

(22) Filed: Feb. 2, 2010

(65) Prior Publication Data

US 2010/0214327 A1 Aug. 26, 2010

Related U.S. Application Data

(63) Continuation-in-part of application No. 12/391,804, filed on Feb. 24, 2009.

(51) Int. Cl.
*G09G 5/10* (2006.01)

(52) U.S. Cl. ..... 345/690; 345/87; 345/88; 345/89

(58) Field of Classification Search ..... 345/87, 345/88; 382/233
See application file for complete search history.

(56) References Cited

U.S. PATENT DOCUMENTS

| | | | | |
|---|---|---|---|---|
| 5,337,068 | A | 8/1994 | Stewart et al. | |
| 6,570,554 | B1 | 5/2003 | Makino et al. | |
| 6,714,681 | B1 * | 3/2004 | Nakamura | 382/233 |
| 6,831,621 | B2 * | 12/2004 | Nakano | 345/87 |
| 6,911,963 | B2 * | 6/2005 | Baba et al. | 345/88 |
| 7,057,668 | B2 | 6/2006 | Herrmann | |

OTHER PUBLICATIONS

Jongseo Lee, Taejong Jun, Jooyoung Lee, Jungsuk Han, Jun H. Souk, Noble Measurement Method for Color Breakup Artifact in FPDs, IMID/ IDMC '06 Digest, p. 92-97. 5-3/ J. Lee, 2006.

* cited by examiner

*Primary Examiner* — Quan-Zhen Wang
*Assistant Examiner* — Troy Dalrymple
(74) *Attorney, Agent, or Firm* — WPAT PC; Justin King

(57) ABSTRACT

An adaptive feedback control method of a field sequential color display includes converting gray-scale values of a three primary color field of an input image into gray-scale values of a new three primary color field and a dominated color field (D-field); performing sampling; performing a pixel by pixel sum operation for each separated color through color gamut conversion to obtain a color difference sum; performing a feedback control at a bit precision to obtain a minimum color difference sum; and then performing a liquid crystal/backlight synchronization step of synchronizing a liquid crystal signal and a backlight gray-scale value of the input image; or dividing the input image into a plurality of blocks; performing feedback control operations; obtaining a minimum sum in each block to serve as an optical backlight value, thereby reducing a CBU phenomenon, and minimizing or controlling the generated CBUs to reduce the operation loads.

3 Claims, 14 Drawing Sheets

ADAPTIVE FEEDBACK CONTROL METHOD OF FSC DISPLAY

CROSS-REFERENCE TO RELATED APPLICATIONS AND PATENTS

This application claims priority as a CIP application based on prior Non-Provisional application Ser. No. 12/391,804, filed Feb. 24, 2009, which is incorporated by reference.

BACKGROUND OF THE INVENTION

1. Field of Invention

The present invention relates to an image displaying technique, and more particularly to an adaptive feedback control method, suitable for performing an adjustment in real time according to a frame content to achieve a backlight color field with a minimum image color difference, thereby alleviating a color break-up (CBU) phenomenon of a field sequential color (FSC) display.

2. Related Art

A conventional liquid crystal display (LCD) utilises a color filter to achieve full-color effects, but the luminous efficiency thereof is not desirable. Based on a fast-response liquid crystal panel, such as an optically compensated bend (OCB) mode, and a backlight source, such as a high-efficient light-emitting diode (LED), developed in recent years, an LCD with a field sequential color (FSC) mechanism has been achieved. Particularly, the speed for sequentially displaying main color fields of red, blue and green is higher than a time resolution of a response of human eyes, so that the full-color effects can be achieved without requiring any color filter. Through combining the backlight of LEDs with the liquid crystal panel in the OCB mode, an FSC-LCD is expected to become a color LCD with a high luminous efficiency, low power consumption and low material cost.

However, generally, the critical problem of a conventional FSC-LCD lies in a color break-up (CBU) problem. The CBU problem is caused by a relative movement between an object in an image and eyes of an observer, that is, during a saccade interval of human eyes, a signal from human eyes to human brains is suppressed due to a saccadic suppression. Referring to FIG. 1, a CBU image simulated with an RGB FSC is shown. In the CBU image M1 simulated by using three primary color sub-fields R, G and B, the CBU phenomenon can be recognized, and as a result, the definition of the whole image is deteriorated. FIG. 2 is a schematic view of a color image displaying method in a conventional FSC. Referring to FIG. 2, under a circumstance that an observation spot is moved as time elapsed, the CBU phenomenon can be found through a pattern displayed in an FSC color displaying manner. In the FSC color displaying manner, an image is displayed in a time sequence, and a color sequence thereof is "RGB RGB RGB . . . ", in which R represents a red sub-frame, G represents a green sub-frame and B represents a blue sub-frame. Taking a white image W10 as an example, when it requires to display a white image, in the white image W10 as seen from the observation spot, a combination of B, B, and G is presented on one edge W11 (on the left of FIG. 2) of the white image W10 and a combination of R, R, and G is presented on the other edge W12 (on the right of FIG. 2), which is the so-called CBU phenomenon.

Considering the FSC applications, U.S. Pat. No. 5,337,068 has disclosed a FSC display system and a method for forming an image, in which a liquid crystal device is used together with backlights in three colors of red, blue and green. The three backlights emit lights respectively, and then the liquid crystal device simultaneously adjusts the light flux respectively, thereby constituting sub frames in three different colors, and finally, the red, blue and green sub frames are formed into a color frame. As for the conventional FSC system architecture and the method for forming an image, the CBU phenomenon is rather obvious, which can be easily recognized by the observers.

U.S. Pat. No. 6,570,554 has disclosed an LCD, in which sub color fields of three consecutive frames are regularly converted to solve the CBU problem of the conventional FSC-LCD. When the observer tracks an animation object with his/her eyes at the same speed, an integral result of the three consecutive frames is left on the retina of human eyes without generating the CBU phenomenon. Unfortunately, in this method, when the frequency of the green color field is lower than 50 Hz, the human eyes can perceive a flicker phenomenon, and as a result, the frame quality is deteriorated.

Furthermore, U.S. Pat. No. 7,057,668 has disclosed an image signal processing method for alleviating the CBU phenomenon of the FSC. In a display with red, blue, and green LEDs, or an additional white LED, serving as the backlights, when an image signal is input, it is converted into a YCrCb color system. When a CBU phenomenon of the display content is fairly slight, an image frame is displayed in an FSC manner. When the CBU phenomenon of the display content is rather severe, the backlights are adjusted into all white lights, that is, the red, blue, and green LEDs are all turned on to emit lights, or merely the white LED is turned on to emit lights, thereby suppressing the CBU phenomenon. However, when the backlights are all turned on, color filters are still required for achieving the full-color effects of the image.

Furthermore, Jongseo Lee et al. has published an article entitled "Noble Measurement Method for Color Breakup Artifact in FPDs" in IMID/IDMC'06, in which CIE LUV color coordinates are utilised to analyze the CBU phenomenon, and it is defined that a color difference ($\Delta E$) in the coordinates is a factor for quantification of the CBU. However, in the published document, other novel method for improving the CBU phenomenon is not mentioned.

In terms of alleviating the CBU problem, U.S. Pat. No. 6,911,963 has disclosed an FSC display method for reducing the CBU phenomenon, in which a time sequence of brightness information of an input image information with all the display colors is displayed. In order to display the input image information, that is, synchronously changing the display color and the brightness information, one color image is displayed in at least four sub-field intervals in one frame interval, and one picture signal in at least one sub-field interval is a non-primary color picture signal, which is generated by at least two primary color signals in the input picture signal carrying primary color signals. The processing manner includes converting the gray-scale rgb of the image into a statistical graph of tristimulus values XYZs in a CIE1931XYZ color system, and then converting the statistical graph into corresponding tristimulus values XYZs of backlight colors, thereby determining the color of the additional sub-field.

When the above methods are used, the following three conditions must be preset, including:

(1) the CBU easily occurs at a high-frequency portion of a high-brightness (Y value) signal level;

(2) the CBU easily occurs when a frequency of an X value is larger than that of a Z value; and (3) the CBU easily occurs at a portion with a high Z value, that is, both the X value and the Y value are lower.

Therefore, the color selected from each signal level satisfying the above conditions (1)-(3) is the color of the additional fourth sub-field. However, in order to acquire the color of the fourth sub-field, the statistics of the image must be analyzed first, which is not only time consuming, but also increases the calculation capacity.

In view of the above problems, the inventor has proposed an adaptive feedback control method of an FSC-LCD, so as to overcome the defects of the prior art.

SUMMARY OF THE INVENTION

Accordingly, the present invention is directed to a technique for synchronously updating both liquid crystal and backlight gray-scale information according to an input image content, so that the color brightness originally distributed in various color fields is concentrated in a single color field, which significantly reduces a color difference sum as compared with each pixel of an input frame, thus effectively suppressing the CBU phenomenon.

In order to achieve the above objectives, the present invention provides an adaptive feedback control method of an FSC display, which includes: a reset step of converting gray-scale values of a three primary color field of an input image into gray-scale values of a new three primary color field and a dominated color field (D-field); a sampling step of performing a pixel sampling on a resolution of the input image in a sampling interval; a feedback control step of performing a pixel by pixel sum operation for each separated color on a CBU color value and a color value of the input image in a Lu'v' color space to obtain a color difference sum, and performing a feedback control at a bit precision on the color difference sum, thereby obtaining a minimum color difference sum; and a liquid crystal/backlight synchronization step of synchronizing a liquid crystal signal (LC signal) and a backlight information of the input image according to the minimum color difference sum.

Preferably, the sampling interval is a 2×4 pixel by pixel interval.

Preferably, the color difference sum $\Delta E_{sum}$ is represented as follows:

$$\Delta E_{sum} = \sum_{total-pixel} \sqrt{(L_{CBU} - L_0)^2 + (u'_{CBU} - u'_0)^2 + (v'_{CBU} - v'_0)^2};$$

in which $Lu'v'_{CBU}$ and $Lu'v'_0$ respectively represent the CBU color value and the color value of the input image in the Lu'v' color space.

Preferably, the bit precision is 3-bit precision.

Preferably, the new gray-scale values r', g', b' and d in the reset step are represented in the following equations:

$$r' = T^{-1}(T(r) - T(d) \times BL_r);$$

$$g' = T^{-1}(T(g) - T(d) \times BL_g);$$

$$b' = T^{-1}(T(b) - T(d) \times BL_b); \text{ and}$$

$$d = T^{-1}\left(\min\left(\frac{T(r)}{BL_r}, \frac{T(g)}{BL_g}, \frac{T(b)}{BL_b}, 1\right)\right);$$

in which T(i) represents a transfer function from a gray-scale value i to a transmittance of liquid crystal (LC), and $T^{-1}$ is an inverse function thereof.

Preferably, the interval generates 8 groups of CBU color difference sums (CBU-$\Delta E_{sum}$).

In addition, the present invention provides an adaptive feedback control method of an FSC display, which is applicable to an original image of an input image divided into a plurality of blocks, and includes a sampling step, a reset step and a feedback operation step.

In the sampling step, the original image is sampled to obtain a sampling image with a resolution smaller than that of the original image.

In the reset step, liquid crystal signals of three primary color fields of the input image are converted into backlight signals corresponding to liquid crystal signals of new three primary color fields and a D-field.

The feedback operation step further includes a time delay step, a subtract step and a sum-up step.

In the time delay step, the liquid crystal signals of the new three primary color fields are delayed for different time intervals.

In the subtract step, the liquid crystal signals corresponding to the color fields are subtracted from each other and then absolute values of subtracting results are obtained.

In the sum-up step, a sum operation is performed on each color field in the subtract step, so as to obtain sums of each block.

The sampling step, the reset step and the feedback operation step are performed from the initial block to the final block among the blocks, and then a minimum sum is obtained from the sums calculated for each block to serve as a backlight signal of each block, and is provided for the operations of the next block.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
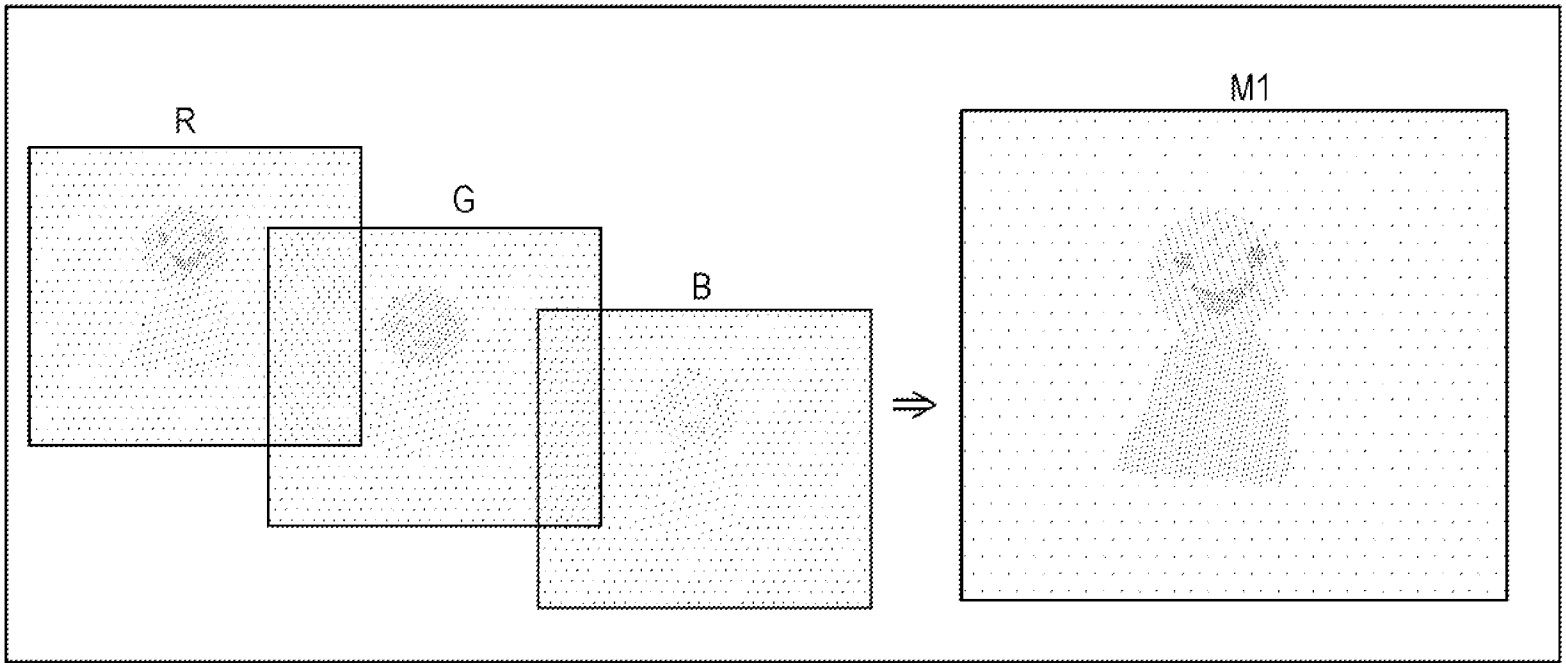
FIG. 1 (Prior Art)
FIG. 1 shows a CBU image simulated with an RGB FSC.
Figure 2:
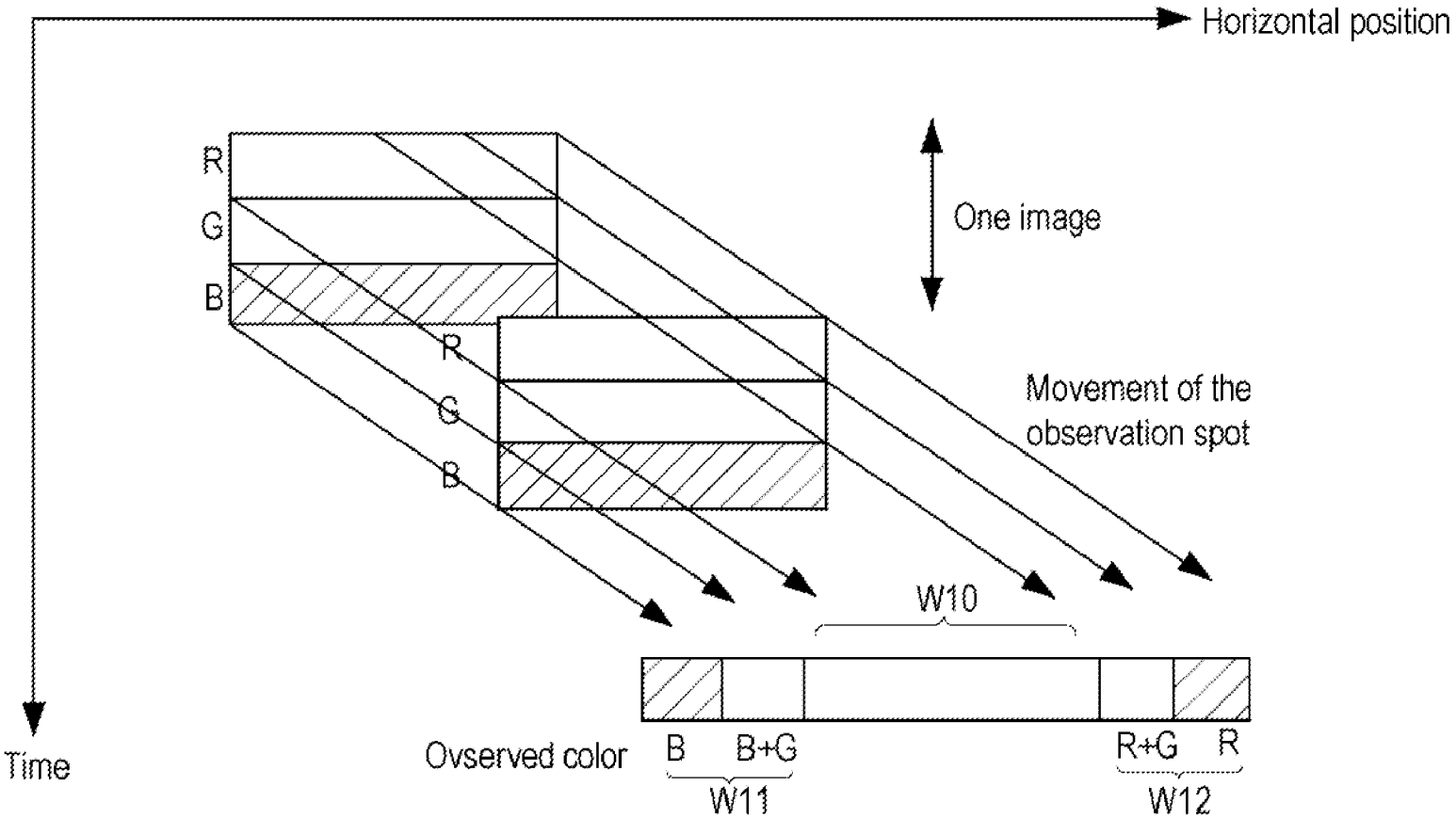
FIG. 2 (Prior Art)
FIG. 2 is a schematic view of a color image displaying method in a conventional FSC.

Although several preferred embodiments are cited in the present invention for illustration, the accompanying drawings and the following specific implementations are merely taken as preferred embodiments of the present invention. It should be noted that, the following specific implementations are merely examples of the present invention, but not intended to restrict the present invention in the drawings and specific implementations.

Hereinafter, embodiments of a method of the present invention are specifically described.

Figure 3:
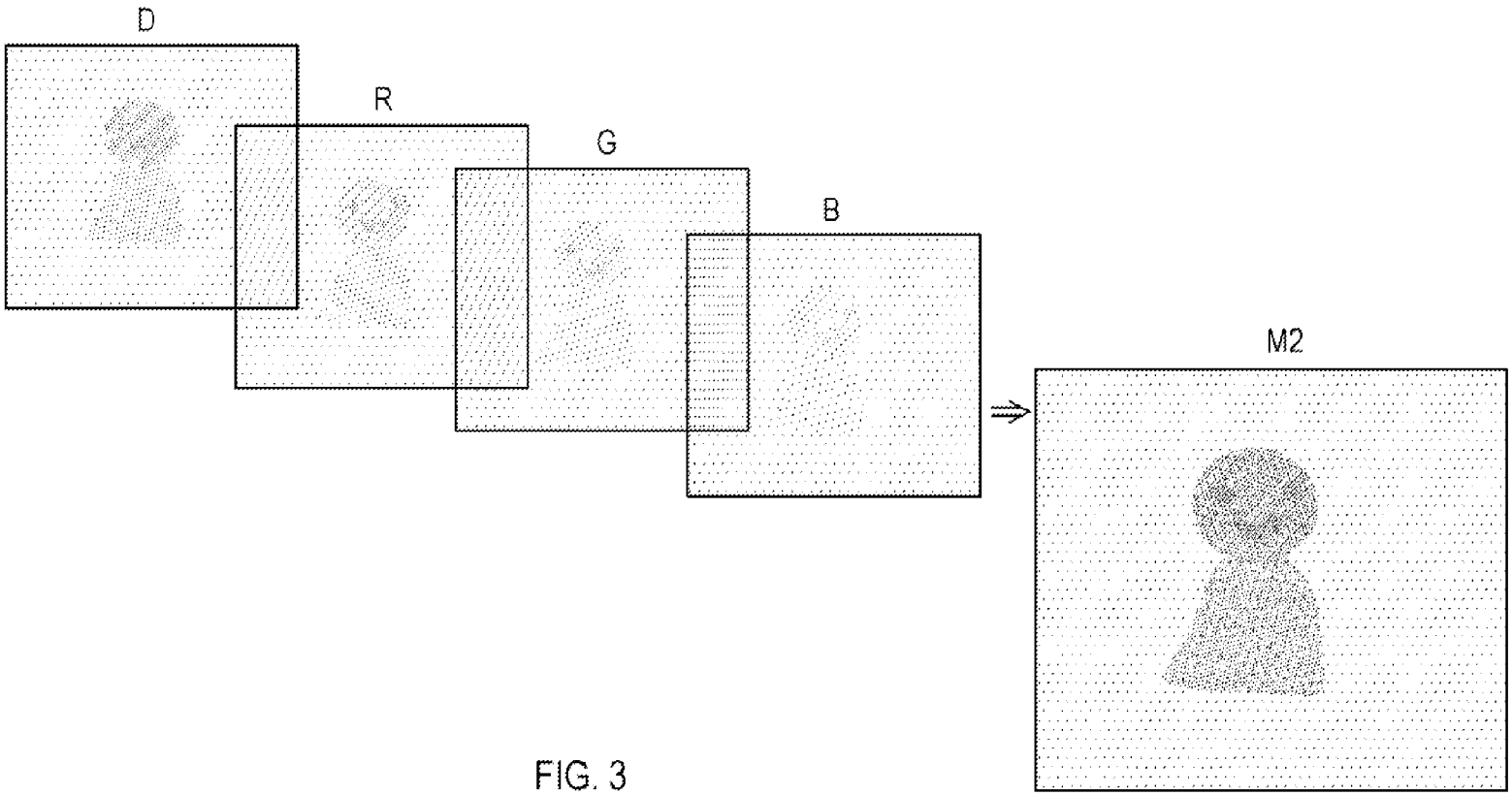
FIG. 3 shows a CBU image simulated through an FSC of a D-field according to the present invention.

In order to particularly suppress the CBU, three primary color sub-fields R, G and B are mainly concentrated on a dominated color field (D-field) D, as shown in FIG. 3. Through rearranging the color fields, an intensity of the primary colors is enhanced, and clearly-distinguished primary color fields are concentrated into a single mixed color field, thereby forming an image M2 capable of suppressing the CBU. Therefore, as compared with the conventional three primary color fields, the present invention achieves the advantages of less CBUs and smaller visibility of the CBU.

Figure 4:
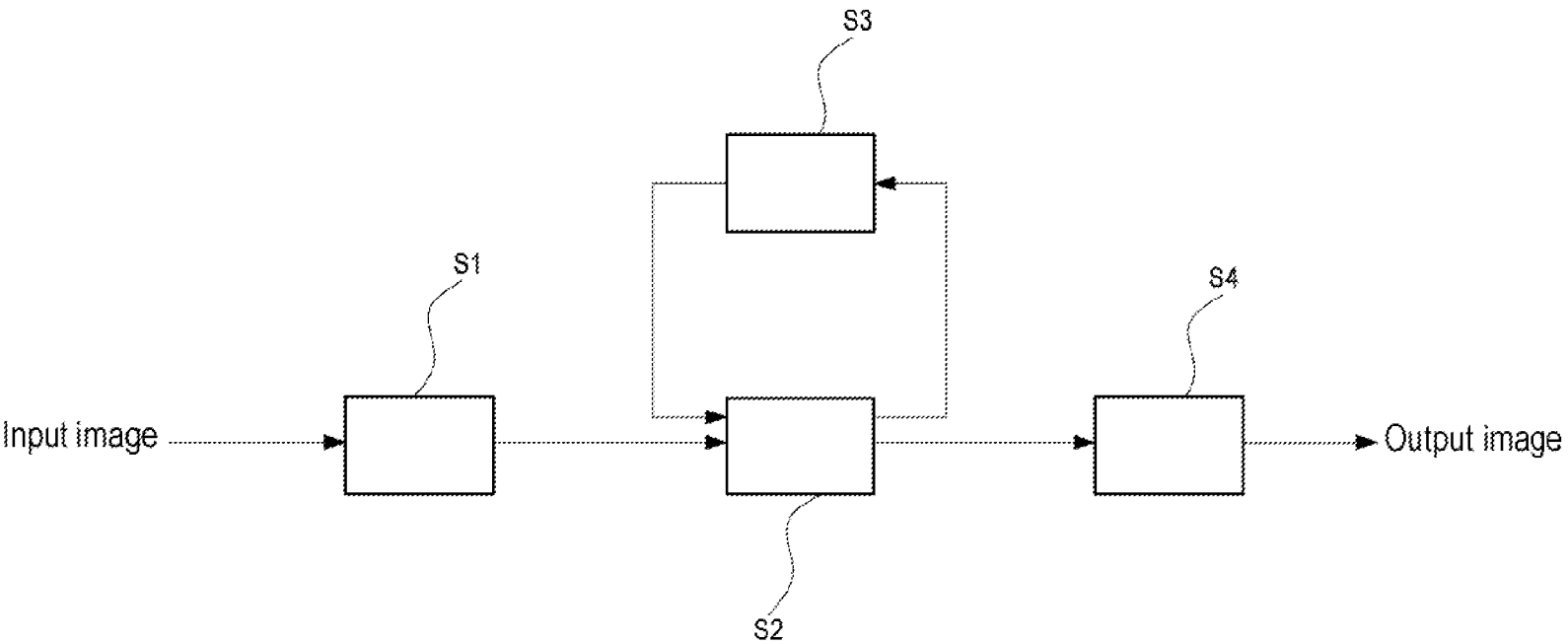
FIG. 4 is a block diagram of a feedback control method according to the present invention.

FIG. 4 is a block diagram of a feedback control method according to the present invention. In order to achieve the above efficacies, the present invention provides feedback determination operational rules for determining the D-field colors and the liquid crystal/backlight signals, so as to meet the requirements of the actual applications. The present invention includes a sampling step S1, a reset step S2, a feedback control step S3 and a liquid crystal/backlight synchronization step S4, which can effectively achieve an optimal backlight value, thereby reducing the influences caused by the CBU.

Sampling Step (S1)

The operational complexity is determined by a resolution of an input image, so that the selected sampling intervals must be compared with each other, and in the sampling ranges from 1×2 to 4×8 pixels, the comparison of the sampling intervals can reduce the calculations and does not influence the image resolution.

Figure 5:
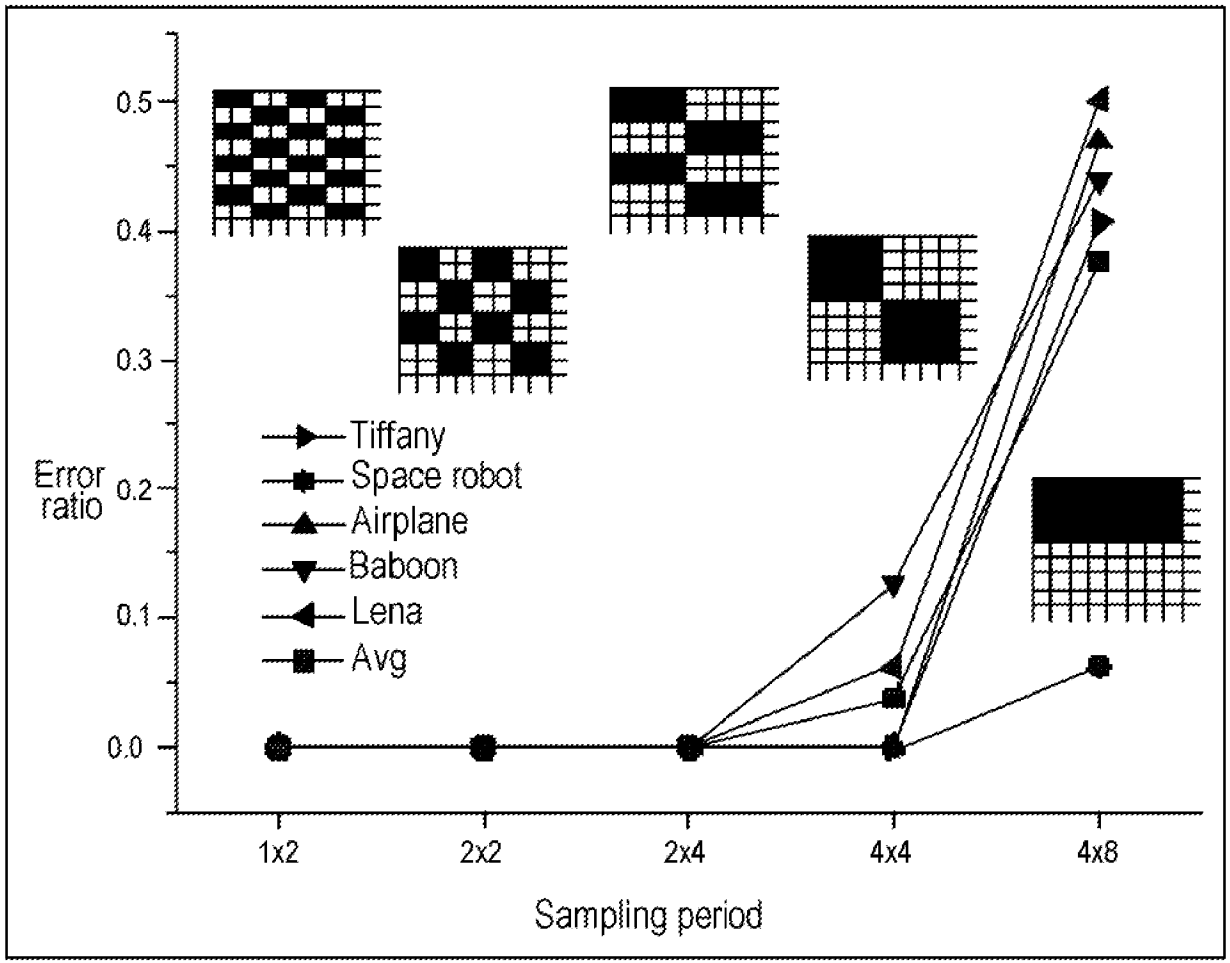
FIG. 5 is a relation diagram generated by comparing an error ratio with a sampling interval of an image.

FIG. 5 is a relation diagram generated by comparing an error ratio with a sampling interval of an image. Referring to FIG. 5, the 2×2 sampling interval is four sub-images with 1/4 resolution, and so forth. If such four sub-images are processed through the $\Delta E_{sum}$ operation to replace the original image, four different backlight statuses can be used together, thereby shortening the step of approaching the minimum $\Delta E_{sum}$. When the minimum $\Delta E_{sum}$ of the sub-image and that of the original image under the three primary color (RGB) backlight status are not equal to each other, such sub-image is considered as an error.

In order to reduce the calculations of the $\Delta E_{sum}$ operation in the subsequent feedback control step (S3) in the actual applications, the optimization of the color backlights on the D-field must be simplified. The image comparison in FIG. 5 is achieved through utilising five images, namely, Tiffany, Space Robot, Airplane, Baboon and Lena (not shown) used in FIG. 6 to perform a comparison between the sub-image and the error ratio respectively. The error ratio is defined as a ratio to the number of errors of all sub-images. As seen from the figure, no error occurs in the sampling interval lower than 2×4 pixels in the five images. Therefore, the 2×4 sampling interval is selected through determining the minimum $\Delta E_{sum}$, so as to provide 8 groups of three primary color (RGB) back lights at the same time.

Reset Step (S2)

The rearrangement of the DRGB color sequential liquid crystal/backlight gray-scales is determined by an image content. In the D-field, the gray-scale values of the three primary color backlights are respectively represented as $BL_r$, $BL_g$ and $BL_b$. The relation (Curve γ) between the gray-scale values and the light intensity is a linear relation. According to the backlight information, the new liquid crystal gray-scale values r', g', b' and d respectively formed in the three primary color fields, namely, red (r), green (g) and blue (b) and the D-field (d) are represented in the following equations.

$$r' = T^{-1}(T(r) - T(d) \times BL_r); \quad \text{Equation (1)}$$

$$g' = T^{-1}(T(g) - T(d) \times BL_g); \quad \text{Equation (2)}$$

$$b' = T^{-1}(T(b) - T(d) \times BL_b); \text{ and} \quad \text{Equation (3)}$$

$$d = T^{-1}\left(\min\left(\frac{T(r)}{BL_r}, \frac{T(g)}{BL_g}, \frac{T(b)}{BL_b}, 1\right)\right); \quad \text{Equation (4)}$$

in which, T(i) represents a transfer function from a gray-scale value i to a transmittance of LC, and $T^{-1}$ represents an inverse function thereof. The Curve γ between the gray-scale value and the transmittance is lower than 1 aims to maintain a white balance.

Feedback Control Step (S3)

The determination of the color backlights of the D-field is very important for reducing the CBU. Referring to FIG. 7, it shows simulated CBU images of a test image under three different backlight gray-scale statuses of the D-field. The simulated CBU image may be formed by four different translated color images. The software adopted for simulation is MATLAB. FIG. 7A shows a CBU image when the conventional D-field has a zero-RGB value (briefly referred to as a KRGB color field). In other words, such an image is obtained upon being driven by a conventional three primary color field. On the contrary, FIG. 7B shows an image generated in a white display mode when a conventional D-field provides the highest RGB value (a WRGB color field).

Figure 7C:
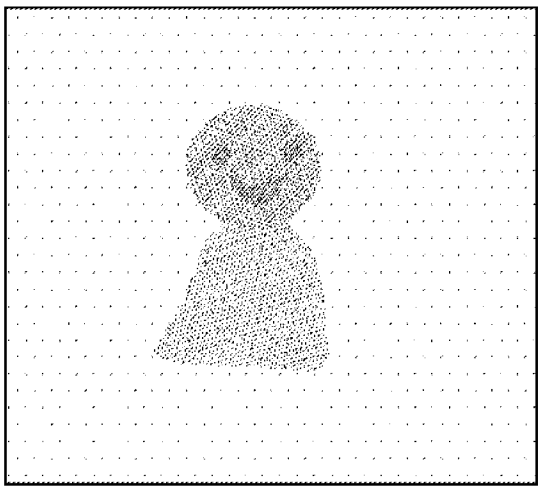
FIG. 7C shows an image generated when a color difference between the CBU and the original image are summed up (a DRGB color field) according to the present invention.
Figure 7B:
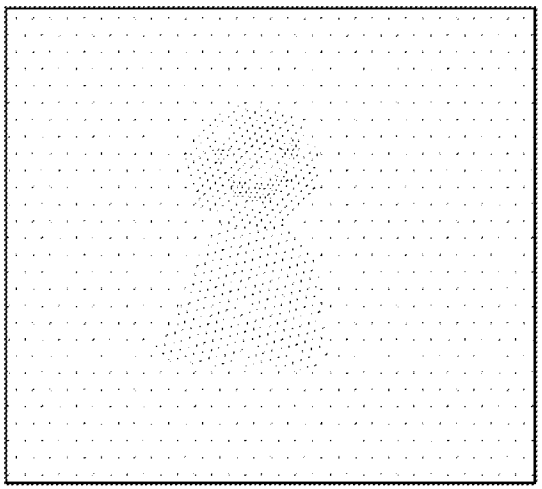
FIG. 7B shows an image generated in a white display mode when a conventional D-field provides the highest RGB value (a WRGB color field).
Figure 7A:
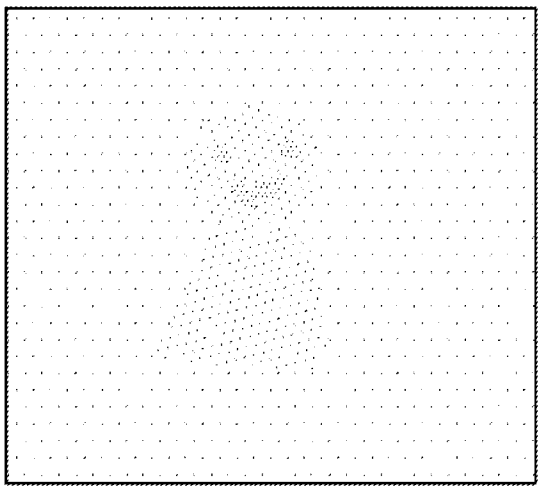
FIG. 7A shows a CBU image when a conventional D-field has a zero-RGB value (a KRGB color field).

As shown in FIG. 7C, it shows an image generated when the color difference between the CBU and the original image are summed up in the D-field (briefly referred to as a DRGB color field), in which they are summed up through an operation of pixel by pixel sum for separated colors, and the color difference sum $\Delta E_{sum}$ is represented as follows: i $$\Delta E_{sum} = \sum_{total-pixel} \sqrt{(L_{CBU} - L_0)^2 + (u'_{CBU} - u'_0)^2 + (v'_{CBU} - v'_0)^2}\ ; \quad \text{Equation (5)}$$

in which, $Lu'v'_{CBU}$ and $Lu'v'_0$ respectively represent a CBU color value and a color value of an original image in a Lu'v' color space. The color backlights are determined by a brightness distribution of an image in the color field. When the brightness is mainly focused on the D-field, the colors of the three primary color field disappear, and thus, less CBUs are generated. It can be found that, among three images shown in FIG. 7, the CBU phenomenon of the image generated by the $\Delta E_{sum}$ in the DRGB color field is less than that of the images generated by the other two color fields (KRGB and WRGB), and thus the CBU phenomenon is reduced.

Figure 6:
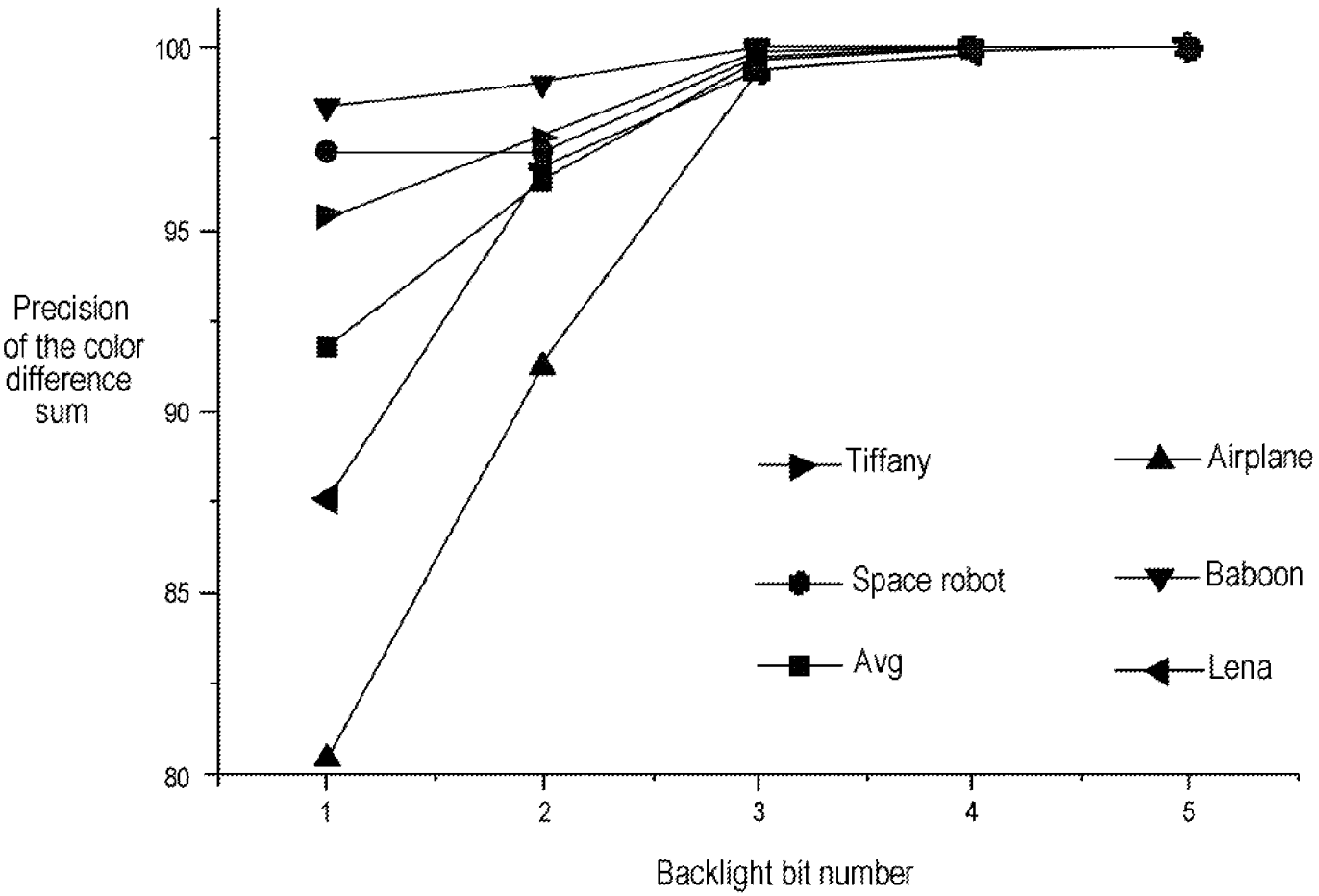
FIG. 6 is a relation diagram between a backlight bit number and a precision of a color difference sum $\Delta E_{sum}$ for five test images.

In the actual applications of calculating the $\Delta E_{sum}$, the optimization for the gray-scale values of the color backlights on the D-field must be simplified. The more bits the backlight has, the more precise the minimum $\Delta E_{sum}$ is included, as shown in FIG. 6. However, as the precisions of the backlights are increased, the calculation loads is also increased at an exponential rate. FIG. 6 shows a relation diagram of backlight bits and the precision of the color difference sum $\Delta E_{sum}$ for five test images. As compared with a precision at 1 bit, when the number of bits is larger than 3, it indicates that $\Delta E_{sum}$ of the five test images is saturated. Thus, the precision at 3 bits is set as a modified factor of the RGB backlights, that is, the feedback control is performed with the backlights at 3 bits, thereby achieving the optimal precision and reducing the calculations.

After the above three steps have been performed, that is, through the reset step S2 of calculating the $\Delta E_{sum}$, the sampling step of sampling in the 2×4 sampling interval, and the feedback control step S3 performed with the precision at 3 bits, the minimum $\Delta E_{sum}$ is obtained, and finally, a liquid crystal/backlight synchronization step S4 of determining the backlights is performed. In the synchronization step, a buffer is used for the time delay, so as to achieve a synchronization effect between an LC signal and a backlight signal. Therefore, when the color backlights generated through a manner of the D-field are optimized, the CBU phenomenon is effectively reduced. What's more, the influences caused by the CBU are determined by the $\Delta E_{sum}$ value.

Figure 8A:
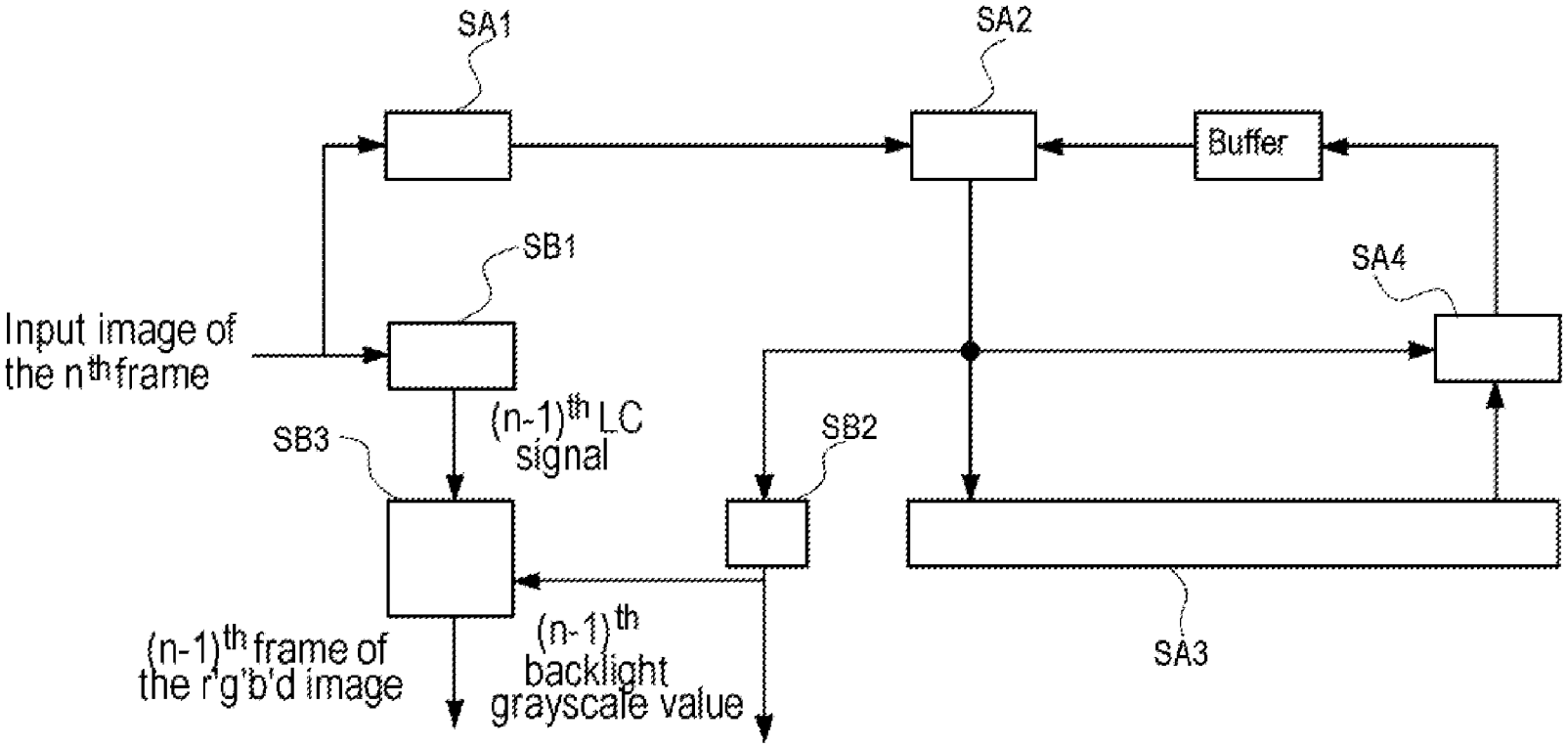
FIG. 8A is a detailed flow chart for determining a gray-scale value of a liquid crystal and that of color backlights.
Figure 8B:
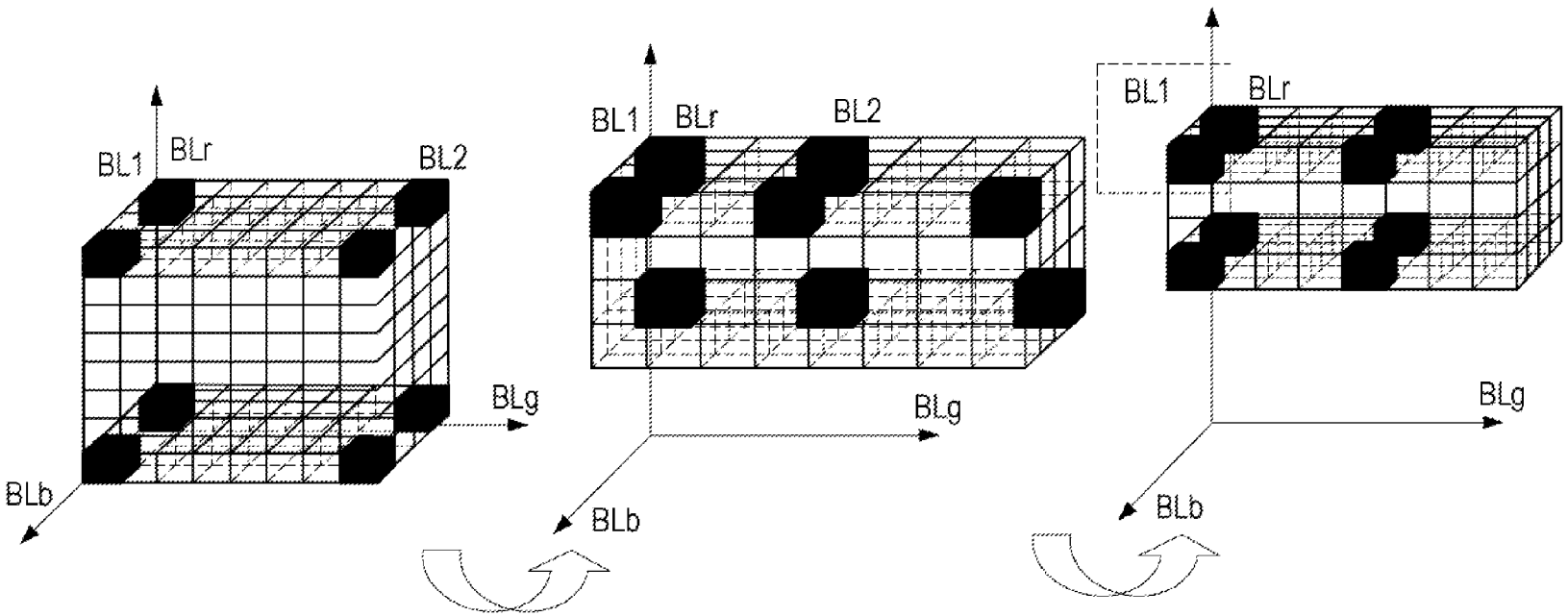
FIG. 8B is a schematic view of ultimate backlight values obtained through an approximation with a precision at 3 bits.

FIGS. 8A and 8B are respectively a detailed flow chart for determining a gray-scale value of the liquid crystal and that of the color backlights and a schematic view of ultimate backlight values obtained through an approximation with a precision at 3 bits. This embodiment includes a color difference sum acquisition step and a signal synchronization step, which are described below in detail through a specific embodiment.

The color difference sum acquisition step includes the following steps.

In Step SA1, an image in the $n^{th}$ frame is converted into a Lu'v' color space.

In Step SA2, a sampling is performed on 8 sets of 1-bit backlight number and sub-images in a 2×4 sampling interval, and a synchronization 8CBU-$\Delta E_{sum}$ ($\Delta E_{sum}$ of 8 sets of CBUs) is performed on the CBU image through comparing with the original input image.

In Step SA3, $\Delta E_{sum}$ are filtered and the bit numbers for the next frame is determined.

In Step SA4, consider to be the minimum $\Delta E_{sum}$ of new 7 sets of 2-bit groups from each two adjacent 1-bit groups of color backlight having minimum $\Delta E_{sum}$ respectively.

The filtering condition N in Step SA3 is listed as follows:

$$N(n+1) = \begin{cases} 2, & \text{when } n = 1 \\ \min(N(n)+1, 3), & \text{if } (\Delta E^i_{sum})_n \le (\Delta E^1_{sum})_{n-1},\ 1 \le i \le 8; \\ \max(N(n)-1, 1), & \text{if } (\Delta E^i_{sum})_n > (\Delta E^1_{sum})_{n-1} \end{cases}$$

In Step SA4, all the 8 groups of color backlights are all processed through a backlight buffer (BL buffer), so as to be used in Step SA2. The buffer is a signal register used for performing synchronization between an LC signal and a backlight signal.

The other part shown in FIG. 8A is a signal synchronization step, i.e., performing synchronization between an LC signal and a backlight signal, which is described below.

In Step SB1, an LC signal of an input image is processed through a frame buffer, so as to obtain a LC signal of a $(n-1)^{th}$ frame.

In Step SB2, a minimum CBU-$\Delta E_{sum}$ of a color backlight is processed through a BL buffer, so as to obtain a backlight gray-scale value of the $(n-1)^{th}$ frame.

In Step SB3, a lookup table (LUT) is used to generate a new LC gray-scale value through using the synchronized LC signal and backlight gray-scale value of the $(n-1)^{th}$ frame.

As shown in FIG. 8B, solid dots in the 1-bit group and the 2-bit group indicate two groups with minimum $\Delta E_{sum}$ (BL1 and BL2), whereas hollow dots indicate the other groups with larger $\Delta E_{sum}$. If the $\Delta E_{sum}$ of any 2-bit group equals to or is smaller than that of the 1-bit group, an approximation operation is performed at 3 bits in the 3-bit group, that is, performed in the Step SA3. On the contrary, if the $\Delta E_{sum}$ of all the 2-bit groups is larger than that of the 1-bit group, 8 groups of 1-bit color backlights are used to perform the CBU-$\Delta E_{sum}$ calculation in the next frame. The bit precision of the color backlights is controlled by a feedback used for determining the backlight optimization.

Therefore, the above feedback control method can reduce the CBU phenomenon, such that the generated CBUs are minimized or controlled to reduce the calculation loads.

In the above method (DRGB color field), the reset step S2 is performed by taking a single frame as a unit (referring to FIG. 4), and color gamut conversion must be performed, which costs a long calculation time. Thus, in order to further shorten the calculation time and omit the color gamut conversion, a single frame is divided into a plurality of displaying blocks, and then the reset step S2 is performed on each displaying block, so as to reduce and minimize the CBU phenomenon, which is further described below in detail.

Figure 9:
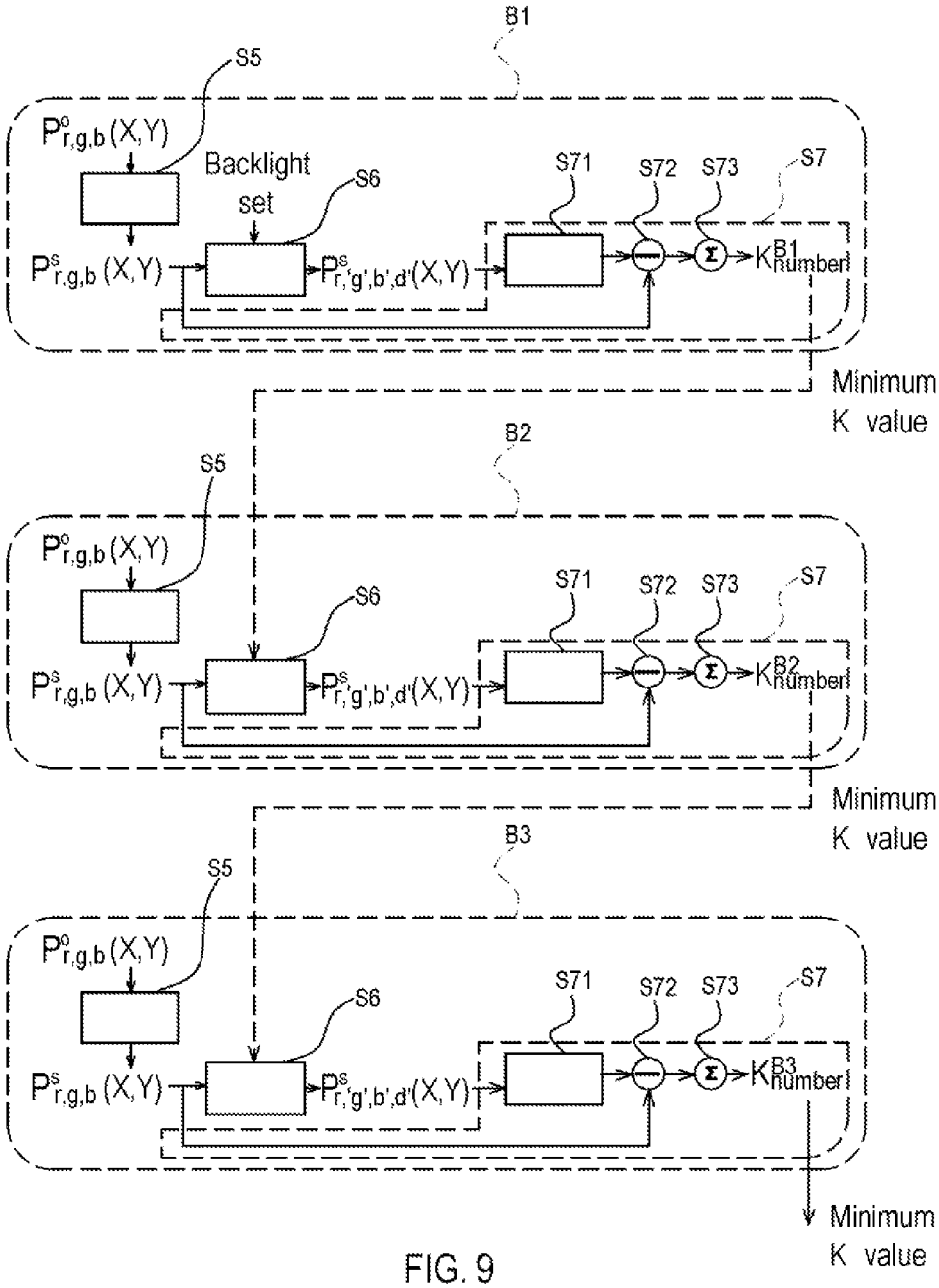
FIG. 9 is a block diagram of a reset step in a feedback control method according to another embodiment of the present invention.

FIG. 9 is a block diagram of a reset step in a feedback control method according to another embodiment of the present invention. Referring to FIG. 9, in this embodiment (Fast DRGB color field), a single frame P is, for example, divided into three blocks, namely, a first block B1, a second block B2 and a third block B3, but the present invention is not limited here. The steps performed on the first block include a sampling step S5, a reset step S6 and a feedback control step S7. $P_{r,g,b}{}^{o}(x,y)$ represents three liquid crystal signals of red, green and blue of an original image $P^o$, in which x and y are graphic coordinates. $P_{r,g,b}{}^{s}(x,y)$ represents three liquid crystal signals of red, green and blue of a sampling image $P^s$. $P_{r',g',b'd}{}^{s}(x,y)$ represents four liquid crystal signals after being processed by a DRGB algorithm step S6. $K_{number}{}^{Block}$ represents a value obtained by sequentially summing up the absolute values of the results obtained by subtracting $P_{r,g,b}{}^{s}(x,y)$ from $P_{r',g',b',d}{}^{s}(x,y)$, in which Block represents a number of divided blocks, and number represents a number of groups participated in the summing-up operation.

Figure 10B:
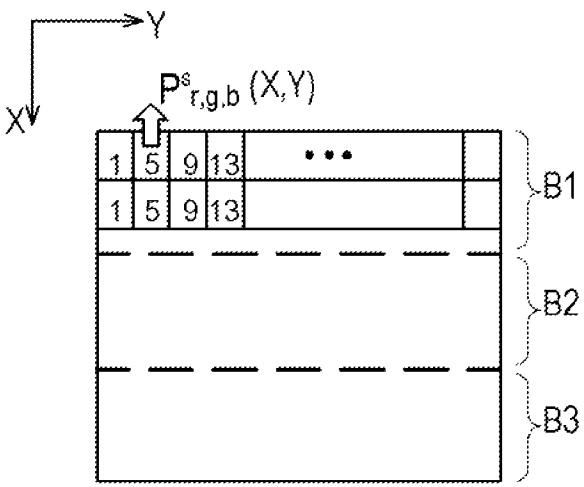
FIG. 10B shows a sampling image after the sampling step according to another embodiment of the present invention.
Figure 10A:
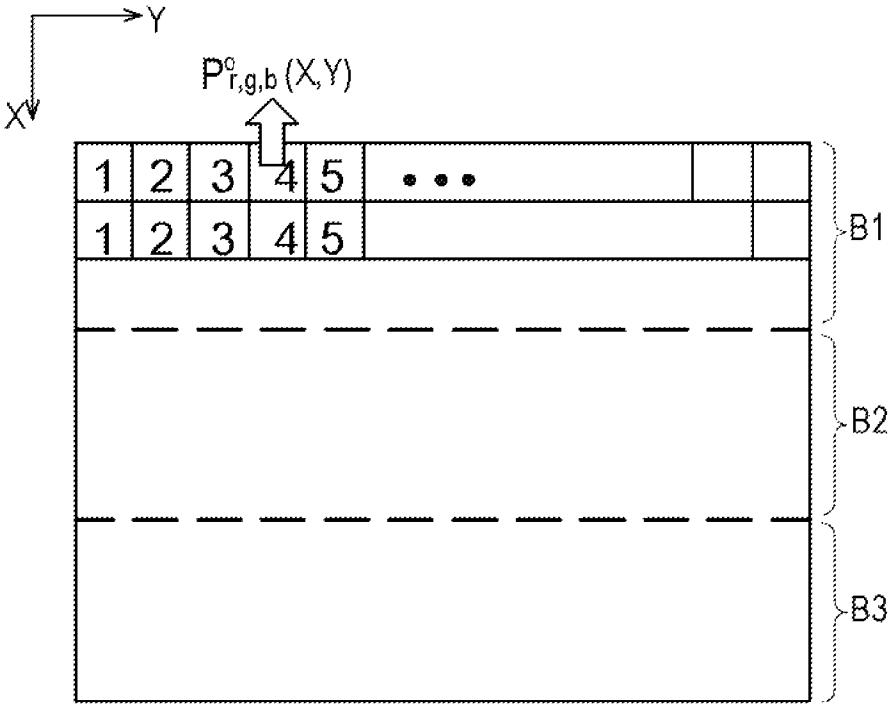
FIG. 10A shows an original image before a sampling step according to another embodiment of the present invention.

FIGS. 10A and 10B respectively show an original image before a sampling step and a sampling image after the sampling step according to another embodiment of the present invention. Referring to FIGS. 10A and 10B, firstly, it is assumed that one signal is taken from four signals in the sampling step S5, so that the resolution of the sampling image $P^s$ (shown in FIG. 10B) after the sampling step becomes smaller than that of the original image $P^o$ (shown in FIG. 10A).

In the reset step S6, the DRGB aims at dividing the original three liquid crystal signals of red, green and blue into four liquid crystal signals, in which new three liquid crystal signals of red, green and blue are corresponding to three backlight signals of red, green and blue, and a fourth D-field d liquid crystal signal is corresponding to a mixed signal of the three backlight signals of red, green and blue. The D-field d liquid crystal signal represents information of the whole picture, so that the new three liquid crystal signals of red, green and blue become smaller, thus suppressing the CBU phenomenon in a better way.

Figure 11A:
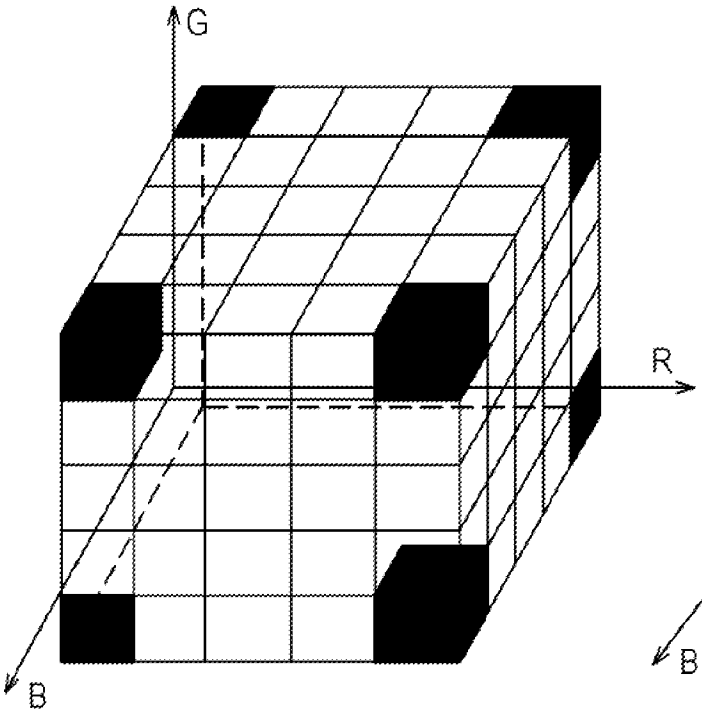
FIG. 11A is a schematic view of sampling a first block in a reset step according to another embodiment of the present invention.
Figure 11B:
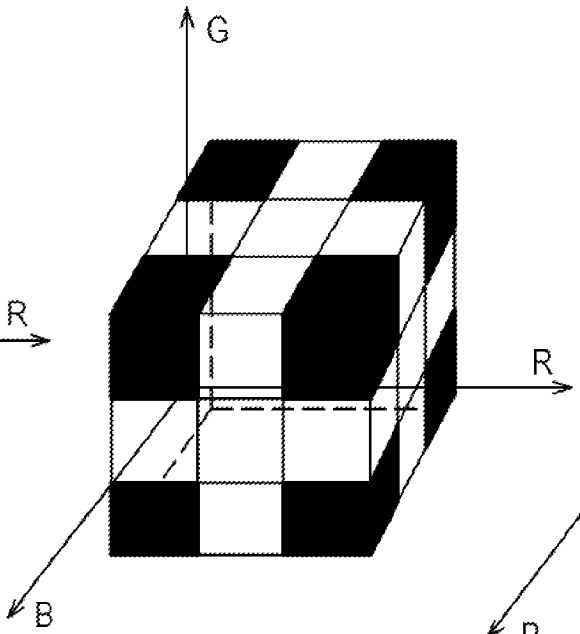
FIG. 11B is a schematic view of sampling a second block in a reset step according to another embodiment of the present invention.
Figure 11C:
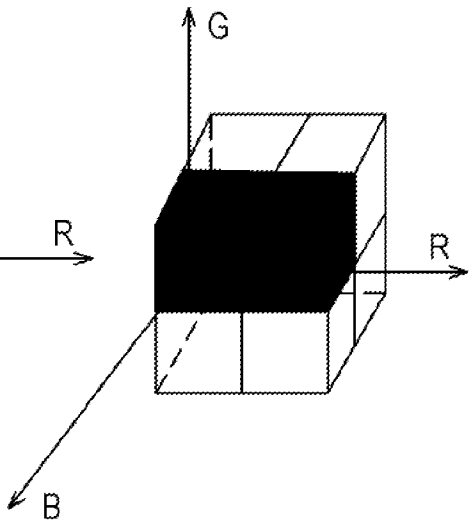
FIG. 11C is a schematic view of sampling a third block in a reset step according to another embodiment of the present invention.

FIGS. 11A, 11B and 11C are respectively schematic views of sampling a first block, a second block and a third block in a reset step according to another embodiment of the present invention. The standard for selecting a backlight signal is concentrating most of the information in the D-field d, so that the brightness of the D-field d cannot be too low. Thus, the gray-scale values of the backlights are in a range between 128 and 255, and are divided into five equal sections, that is, five gray-scale values of the backlights 128, 160, 192, 224 and 255, and three types of backlights red, blue and green exist. That is to say, totally 125 backlight sets are provided. The 125 backlight sets are represented by 125 small cubes (as shown in FIG. 11A). Then, eight small cubes at outermost edges are taken, which represents that 8 backlight sets are selected, that is, (128, 128, 128), (128, 128, 255), (128, 255, 128), (128, 255, 255), (255, 128, 128), (255, 128, 255), (255, 255, 128) and (255, 255, 255), that is, combinations of 128 and 255. Then, according to the eight backlight sets, the liquid crystal signals of the first block B1 are substituted into image signal decomposition equations (Equations (1)-(4)) to calculate the D-field d liquid crystal signal, thereby inversely deriving the new r', g' and b' liquid crystal signals.

Figure 12:
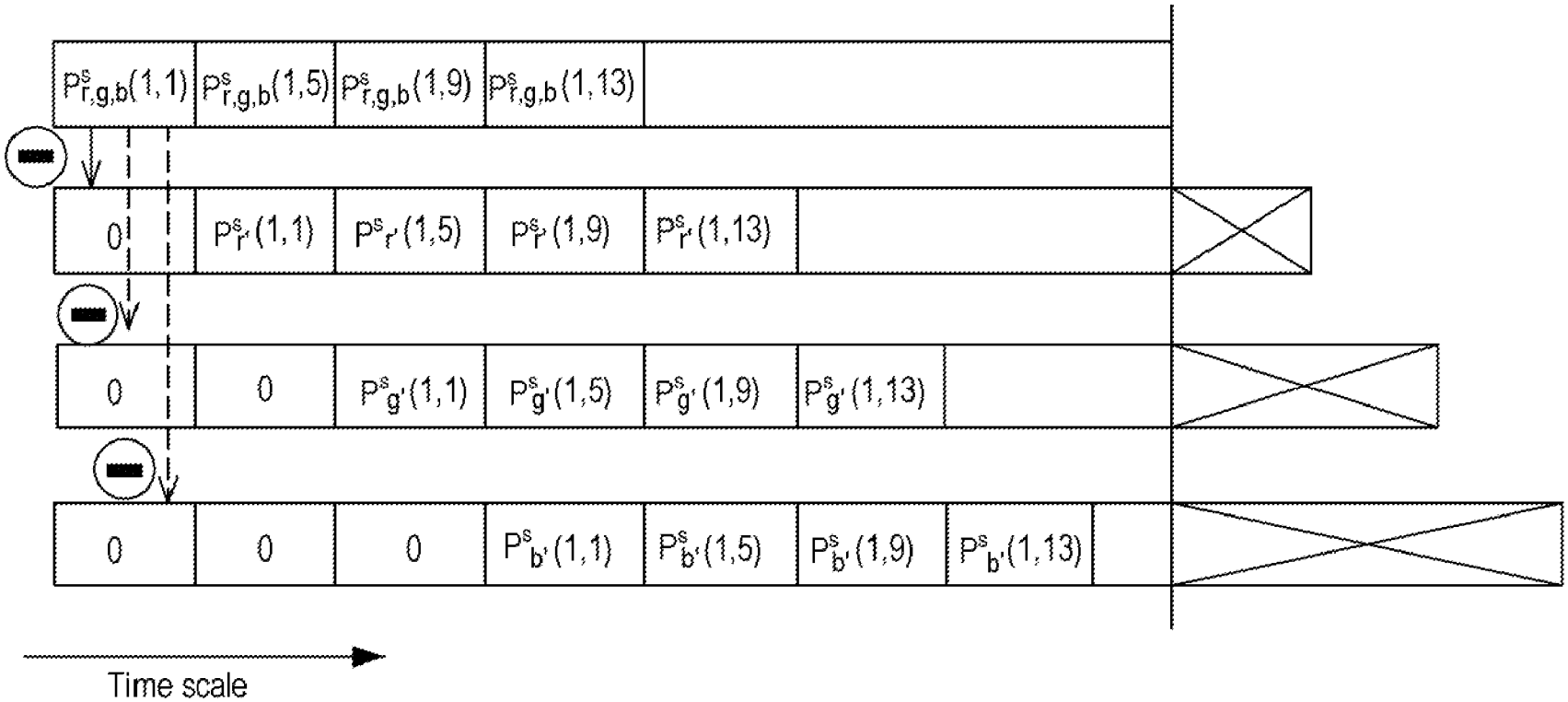
FIG. 12 is a schematic view of a time delay for each signal in a feedback operation step according to another embodiment of the present invention.

FIG. 12 is a schematic view of a time delay for each signal in a feedback operation step according to another embodiment of the present invention. Referring to FIG. 12, in the feedback control step S7, the new r', g' and b' liquid crystal signals are delayed for different time intervals (time delay step, Step S71). For example, r' is delayed for one clock, g' is delayed for two clocks, b' is delayed for three clocks, and the D-field d liquid crystal signal is not delayed (as shown in FIG. 12). Definitely, r' may be delayed for two clocks, g' may be delayed for one clock, b' may be delayed for two clocks, and the D-field d liquid crystal signal may be delayed for three clocks, and the present invention is not limited here. If it is assumed that the D-field d is displayed as the first signal, the delayed r', g' and b' represent signals for simulating the CBU phenomenon. Then, the liquid crystal signals corresponding to the color fields are subtracted from each other according to the time sequence, and then absolute values of the subtracting results are obtained (subtract step, Step S72), that is, $K_n=|T_{R'}-T_R|+|T_{G'}-T_G|+|T_{B'}-T_B|+K_{n-1}$. Then, the absolute values are summed up (sum-up step, Step S73), that is, $$\Delta E\sum_{n=1}^{8} K_n,$$

so that the sums $K_1$-$K_8$ of the first block B1 are obtained.

A minimum sum K is obtained, and it is assumed that the corresponding backlight signal set is (128, 128, 128), which serves as the backlight signal of the first block B1, and it represents that a new image formed on the first block B1 by using the backlight signal can suppress the CBU phenomenon in a better way. Then, the backlight signal is provided for subsequent processing in the reset step S6 of the second block B2.

Referring to FIG. 9B, since the first block B1 has been processed by the feedback control method of the present invention, the original 125 backlight sets (small cubes in FIG. 11A) are converged towards the cube (128, 128, 128), so as to form 27 backlight sets and new gray-scale values of the backlights 128, 160 and 192. Eight cubes at outermost edges of the 27 backlight sets are taken, that is, sequentially (128, 128, 128), (128, 128, 192), (128, 192, 128), (128, 192, 192), (192, 128, 128), (192, 128, 192), (192, 192, 128) and (192, 192, 192). Then, the DRGB algorithm step S6 and the feedback operation step S7 are performed, so as to obtain sums $K_1$-$K_8$ of the second block B2, and then a minimum sum K is selected to serve as a backlight signal of the second block B2.

Similarly, the third block B3 is processed in the same manner as that of the first block B1 and the second block B2, so that the 27 backlight sets are converged into 8 backlight sets, and a minimum sum thereof is obtained to serve as an optimal backlight signal of the third block B3.

To sum up, in the first embodiment (DRGB color field), the image frame is sampled according to a 2×4 sampling cycle, so as to obtain eight sub-images in each block respectively, and each sub-image is set in a different backlight color field. Thus, each different backlight color field can obtain a new different sub-image according to the image signal decomposition equation. The CBU simulation is performed on the new sub-images, and the differences with the signal of the original image are obtained and then summed up. After the approximation is performed under the same mode for three times, and each approximation selects a different backlight color field, the backlight color field with the minimum difference sum is the optimal backlight color field. During the calculations, the optimal result is approximated through a feedback manner using a 3-bit precision, and the corresponding liquid crystal gray-scale value d of the D-field can be obtained by the gray-scale values of the optimal backlight color fields $BL_r$, $BL_g$ and $BL_b$. Meanwhile, the brightness component is switched to the D-field d, so that the modified r', g' and b' need to deduct the contributions made by the D-field d. Thus, the synchronization process of backlight and liquid crystal signals is considered at the same time.

In the second embodiment (Fast DRGB color field), the original image and a CBU image newly formed according to different backlights are directly used to perform a difference sum operation to make comparison between each other, so as to accelerate the calculations. Then, a plurality of blocks, for example, three blocks here, is used. Specifically, when a signal is input to a first block image, the first block image is sampled, and then the image and the CBU image are used to perform a difference sum operation using different backlight color fields, so as to obtain a minimum difference sum, that is, an optimal backlight color field of the first block image. Then, the optimal backlight color field in the first block is provided to a second block image, and the same operations are performed to obtain an optical backlight color field for the second block image. After the approximation for the third block is performed, the final optimal backlight color field is obtained. The operations are performed according to the input image, so that the operations can be performed in real time, without requiring an image register, and once the whole image has been input, the optimal backlight color field is obtained.

Referring to FIGS. 9A and 9B, the current block affects the next block. However, through monitoring the signal writing manner, the blocks may be processed in a parallel manner, and then each block is converged automatically, so as to select the minimum total color difference value of each block, and thus, each block is enabled to have an independent optimal backlight signal thereof. Therefore, in terms of image displaying, the effects the same as that of the above manner can be achieved.

Furthermore, in order to enable the image compensation of the D-field d to become more power-saving, the dimming process may be performed on blue, r, g, and b of the backlight signals corresponding to the liquid crystal signals of red, green, and blue at the same time according to the following new liquid crystal signal decomposition equations (Equation (6)-(9)), which are different from the original equations (Equation (1)-(4)) in that, the backlight signals of blue, r, g and b are dimmed according to their respective backlights, and the backlights of the backlight signals of r, g and b in the original Equation (1)-(4) are taken as a full brightness state.

$$r' = T^{-1}\left(\frac{T(r) - T(d) \times BL_r}{BL_r}\right); \quad \text{Equation (6)}$$

$$g' = T^{-1}\left(\frac{T(g) - T(d) \times BL_g}{BL_g}\right); \quad \text{Equation (7)}$$

$$b' = T^{-1}\left(\frac{T(b) - T(d) \times BL_b}{BL_b}\right); \text{ and} \quad \text{Equation (8)}$$

$$d = T^{-1}\left(\min\left(\frac{T(r)}{BL_r}, \frac{T(g)}{BL_g}, \frac{T(b)}{BL_b}, 1\right)\right). \quad \text{Equation (9)}$$

Figure 13:
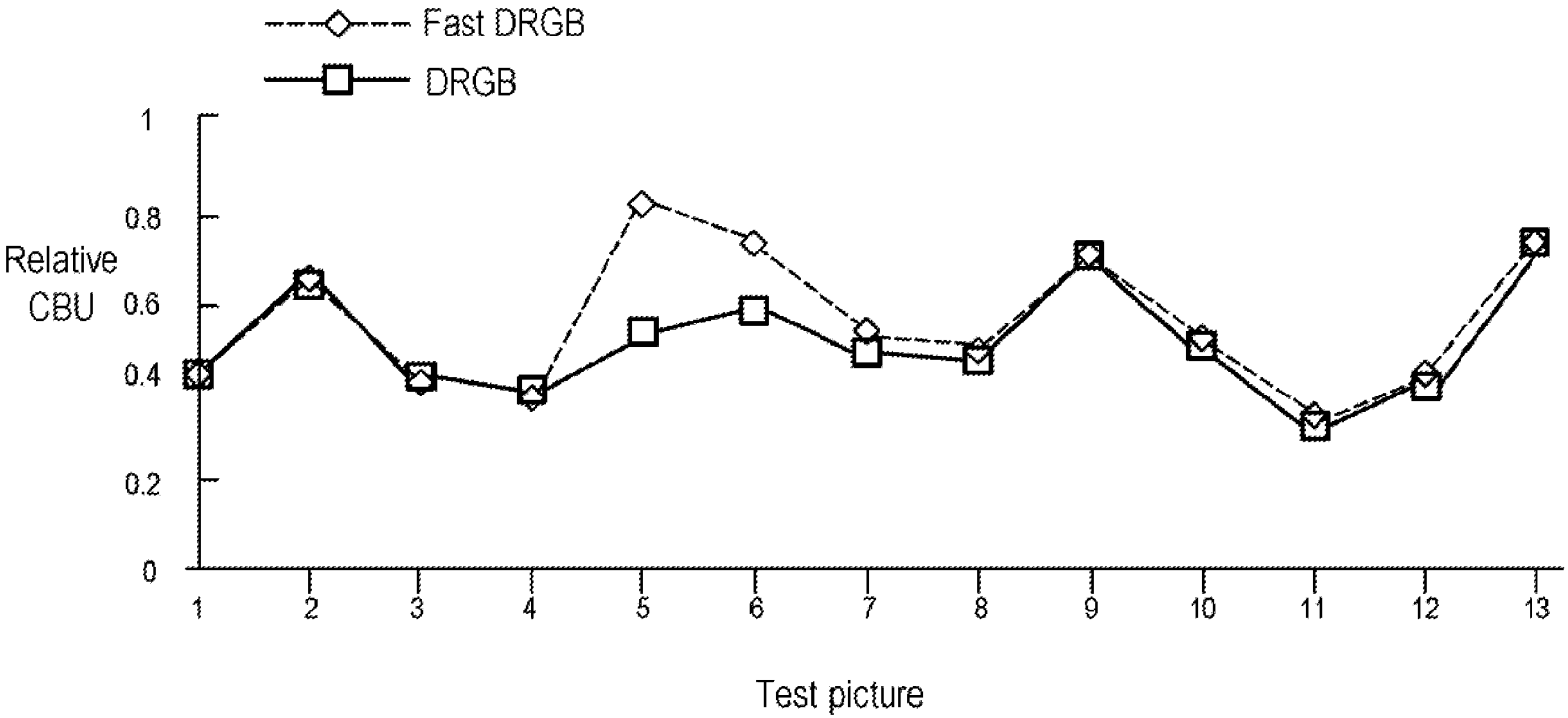
FIG. 13 is a curve diagram of CBU suppression (DRGB and Fast DRGB) according to a second embodiment of the present invention.

This embodiment (Fast DRGB color field) does not use the whole image to perform operations, but divides the whole image into a plurality of blocks, so as to avoid the circumstance that a certain color is concentrated in a certain block. Through using the two embodiments (DRGB and Fast DRGB) of the present invention to compare the relative CBU, it can be known that similar CBU alleviation (shown in FIG. 13) can be achieved, so that the two embodiments of the present invention can both achieve the effects of alleviating the CBU phenomenon.

What is claimed is:

1. An adaptive feedback control method of a field sequential color (FSC) display, applicable to an original image of an input image divided into a plurality of blocks, comprising:

a sampling step, wherein the original image is sampled to obtain a sampling image with a resolution smaller than that of the original image;

a reset step, wherein liquid crystal signals of three primary color fields of the input image are converted into backlight signals corresponding to liquid crystal signals of new three primary color fields and a dominated color field (D-field), a feedback operation step, further comprising:

a time delay step, wherein the liquid crystal signals of the new three primary color fields are delayed for different time intervals, a subtract step, wherein the liquid crystal signals corresponding to the color fields are subtracted from each other, and absolute values of subtracting results are obtained, and a sum-up step, wherein a sum-up operation is performed on each color field in the subtract step, so as to obtain sums of each block, wherein the sampling step, the reset step, and the feedback operation step are performed from an initial block to a final block among the blocks, and a minimum sum is obtained from the sums calculated for each block to serve as a backlight signal of each block and is provided for operations of a next block.

2. The adaptive feedback control method according to claim 1, wherein new gray-scale values r', g', b' and d in the reset step are represented in following equations:

$$r' = T^{-1}(T(r) - T(d) \times BL_r);$$

$$g' = T^{-1}(T(g) - T(d) \times BL_g);$$

$$b' = T^{-1}(T(b) - T(d) \times BL_b); \text{ and}$$

$$d = T^{-1}\left(\min\left(\frac{T(r)}{BL_r}, \frac{T(g)}{BL_g}, \frac{T(b)}{BL_b}, 1\right)\right);$$

T(i) represents a transfer function from a gray-scale value i to a transmittance of liquid crystal (LC), $T^{-1}$ is an inverse function thereof, and $BL_r$, $BL_g$ and $BL_b$ are respectively gray-scale values of red, green and blue three primary color backlights.

3. The adaptive feedback control method according to claim 1, wherein new gray-scale values r', g', b' and d in the reset step are represented in following equations:

$$r' = T^{-1}(T(r) - T(d) \times BL_r);$$

$$g' = T^{-1}(T(g) - T(d) \times BL_g);$$

$$b' = T^{-1}(T(b) - T(d) \times BL_b); \text{ and}$$

$$d = T^{-1}\left(\min\left(\frac{T(r)}{BL_r}, \frac{T(g)}{BL_g}, \frac{T(b)}{BL_b}, 1\right)\right),$$

T(i) represents a transfer function from a gray-scale value i to a transmittance of liquid crystal (LC), $T^{-1}$ is an inverse function thereof, and $BL_r$, $BL_g$ and $BL_b$ are respectively gray-scale values of red, green and blue three primary color backlights.

* * * * *